US008544203B2

(12) United States Patent
Jackson

(10) Patent No.: US 8,544,203 B2
(45) Date of Patent: Oct. 1, 2013

(54) LASER AIMED SMALL ARMS AMMUNITION

(75) Inventor: Charles Jerome Jackson, Paragould, AR (US)

(73) Assignee: Dotshot Ammo, LLC, Paragould, AR (US)

( * ) Notice: Subject to any disclaimer, the term of this patent is extended or adjusted under 35 U.S.C. 154(b) by 123 days.

(21) Appl. No.: 12/806,827

(22) Filed: Aug. 23, 2010

(65) Prior Publication Data

US 2012/0042560 A1 Feb. 23, 2012

(51) Int. Cl.
*F41G 3/26* (2006.01)

(52) U.S. Cl.
USPC ..... 42/116; 42/134; 102/472

(58) Field of Classification Search
USPC ..... 42/116, 134; 102/470, 471, 472
See application file for complete search history.

(56) References Cited

U.S. PATENT DOCUMENTS 2,773,309 A * 12/1956 Elliott ..... 42/134
4,048,489 A * 9/1977 Giannetti ..... 362/110
2010/0011648 A1* 1/2010 Hopkins ..... 42/116

* cited by examiner

*Primary Examiner* — Stephen M Johnson
(74) *Attorney, Agent, or Firm* — Butler, Snow, O'Mara, Stevens & Cannada PLLC

(57) ABSTRACT

A projectile cartridge device designed with internal sighting and aiming system, which incorporates and leverages electromagnetic radiation as the means for aiming the projectile.

8 Claims, 9 Drawing Sheets

LASER AIMED SMALL ARMS AMMUNITION

CROSS-REFERENCE TO RELATED APPLICATION

Not applicable.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not applicable.

BACKGROUND OF THE INVENTION

1. Field

This invention relates to aiming a firearm, specifically with live ammunition containing a battery and laser module that emits a visible light only when inserted in the chamber of said firearm.

2. Prior Art

The following is a tabulation of some prior art that presently appears relevant:

| Pat. No. | Kind Code | Issue Date | Patentee |
|---|---|---|---|
| 3,633,285 | B1 | Jan. 11, 1972 | Sensney |
| 3,782,832 | B1 | Jan. 01, 1974 | Hacskaylo |
| 3,813,795 | B1 | Jun. 04, 1974 | Marshall, et al. |
| 3,972,286 | B1 | Aug. 03, 1976 | Canon |
| 4,281,993 | B1 | Aug. 04, 1981 | Shaw |
| 4,481,561 | B1 | Nov. 06, 1984 | Lanning |
| 4,627,183 | B1 | Dec. 09, 1986 | Stuckman |
| 4,678,437 | B1 | Jul. 07, 1987 | Scott, et al. |
| 4,879,814 | B1 | Nov. 14, 1989 | Wallace |
| 5,031,349 | B1 | Jul. 16, 1991 | Vogel |
| 5,153,375 | B1 | Oct. 06, 1992 | Eguizabal |
| 5,365,669 | B1 | Nov. 22, 1994 | Rustick, et al. |
| 5,446,535 | B1 | Aug. 29, 1995 | Williams |
| 5,454,168 | B1 | Oct. 03, 1995 | Langner |
| 5,488,795 | B1 | Feb. 06, 1996 | Sweat |
| 5,618,099 | B1 | Apr. 08, 1998 | Brubacher |
| 5,685,106 | B1 | Nov. 11, 1997 | Shoham |
| 5,787,631 | B1 | Aug. 04, 1998 | Kendall |
| 5,909,951 | B1 | Jun. 08, 1999 | Johnsen, et al. |
| 6,061,918 | B1 | May 16, 2000 | Schnell |
| 6,151,788 | B1 | Nov. 28, 2000 | Cox, Young |
| 6,068,484 | B1 | May 30, 2000 | O'Loughlin, et al. |
| 6,295,753 | B1 | Oct. 2, 2001 | Thummel |
| 6,389,730 | B1 | May 21, 2002 | Millard |
| 6,397,509 | B1 | Jun. 4, 2002 | Langner |
| 6,421,947 | B1 | Jul. 23, 2002 | Fuller |
| 6,513,251 | B2 | Feb. 4, 2003 | Huang, et al. |
| 6,572,375 | B2 | Jun. 3, 2003 | Shechter, et al. |
| 6,579,098 | B1 | Jun. 17, 2003 | Shechter |
| 6,606,797 | B2 | Aug. 19 2003 | Gandy |
| 6,631,580 | | Oct. 14, 2003 | lafrate, et al. |
| 6,742,299 | | Jun. 1, 2004 | Strand |

U.S. Patent Application Publications

| Publication No. | Kind Code | Publ. Date | Applicant |
|---|---|---|---|
| 2001/0042335 | A1 | Nov. 22, 2001 | Strand |
| 2002/0129536 | A1 | Sep. 19, 2002 | lafrate, et al. |
| US 2010/0011648 | A1 | Jan. 21, 2010 | Hopkins |
| US 2010/0083861 | A1 | Apr. 08, 2010 | Joys, et al. |

Historically either iron or telescopic sights have been mounted on firearms to assist in aiming. To use such sights, a firearm is brought to just below the line of sight and the sights engaged by the shooter's eye. When the sights are lined up with the target, the bore of the firearm should be aligned with the target as well. Discharging the firearm while the sights are aligned will theoretically guide the shot to the point of aim.

However, several problems have plagued shooters through the years. Iron sights can be difficult to align in stressful situations. In low light situations iron sights may not even be visible. In stressful situations, it is common for shooters to ignore the sights of their firearm and, instead, visually focus on the threat presented by an aggressor. ("On Killing", Lt. Col. Dave Grossman) In such situations, even properly calibrated sights are of little or no value. Even with extensive training, police officers statistically miss more than 50% of shots fired at an average distance of less than seven feet. Telecopic sights, such as telescopes mounted on a firearm, are also prone to misalignment, are easily damaged, and are difficult to use in low light situations.

In the case of a shotgun, again, well-trained soldiers and police officers frequently miss more than half their shots. The average distance of most of these shots is less than ten yards. ("On Killing", Lt. Col. Dave Grossman). A common assumption is that shotgun pellets will spread to encompass whatever is within the shooter's vision. Thus, shooters may often point a shotgun toward the target rather than aim, possibly even firing from below their line of sight. Shot spreads approximately one inch per yard from the muzzle of the firearm. Thus, a target perceived impossible to miss across the room at 21 feet may easily be missed by the seven-inch pattern.

Some laser devices are used to illuminate a target when shooting live ammunition. Such devices are attached to the exterior of a weapon. (Stockman, U.S. Pat. No. 4,627,183, Dec. 9, 1986) Laser lights have been used for such applications since they offer an extremely straight line of reference, culminating in a bright dot of light on the target. These are activated by the operator through various switches. Such devices add bulk and an additional level of complexity to the operation of the weapon. Extra weight and/or bulk are not commonly desirable. Also, complexity tends to increase the chance of equipment failure.

Such external laser devices are not often used by homeowners. It is common to use the same firearm for both hunting and home defense. Since many states prohibit the use of any type of firearm-mounted light for hunting, such a device possibly used for home defense would have to be removed for hunting. This produces an inconvenience. The cost of such devices prohibits their use as well.

Prior art has placed a laser module in a cartridge-shaped cylinder as an aid in adjusting the external sights of a firearm. Said laser module is placed in the chamber or bore of said firearm. (Shaw, U.S. Pat. No. 4,281,993, Aug. 4, 1981 and others) When activated, the laser travels coaxially down the bore and illuminates the target. Telescopic or iron sights are then aligned with the visible dot on the target. The laser module is removed from the firearm and replaced with live ammunition. When the round is fired, it should impact on or very near the point of aim. These devices cannot, however, be used in a live fire situation.

One patent discovered during research (Hopkins, Pub. No.: US 2010/0011648 A1) uses a laser module that is external to the chamber of the firearm. It is mounted in the stock of the firearm and allows a laser beam to traverse the mechanical action, the chamber then through the bore of the firearm. A special rim-fire cartridge with a longitudinal tube through the central axis provides passage for the visible laser light. This, however, requires specially modified firearms and ammunition.

Prior art has used a laser module in firearm training aids to increase proficiency, reduce expense and to avoid the danger of using live rounds. (Powell et at. U.S. Pat. No. 5,591,032, Jan. 7, 1997) Such devices are mounted in such a way as to point parallel with the bore of a firearm. They can be externally mounted or mounted in the chamber of a firearm. In these systems a light detector is placed on the target. The detector reacts to the frequency of light emitted by the laser module in or on the firearm when the trigger is pulled. When a "hit" is scored, the detector emits a noise, vibration, or other indicator. Such prior art is good for training, but is of no use in actual combat or self defense situations.

BRIEF SUMMARY OF THE INVENTION

In accordance with one embodiment a sighting device for firearms housing a laser module, battery, and associated circuitry within a live ammunition cartridge.

Accordingly several advantages of one or more aspects are as follows: simplicity in having no moving mechanisms to fail, simplicity of construction reduces cost of the device enabling its purchase by most firearm owners, simplicity of operation and use, eliminates the need for training beyond normal firearms safety rules, a bright dot of light appearing directly on the target eliminates the need for optical or iron sights, no modification of the firearm is necessary (The cartridge will fit in the chamber of any firearm designed to hold said cartridge), safe to fire in any modern firearm capable of firing modern ammunition, is convenient, legal for its intended purpose, is single use and virtually disposable, and intended for live fire. Other advantages of one or more aspects will become apparent from a consideration of the drawings and ensuing description.

Figure 1:
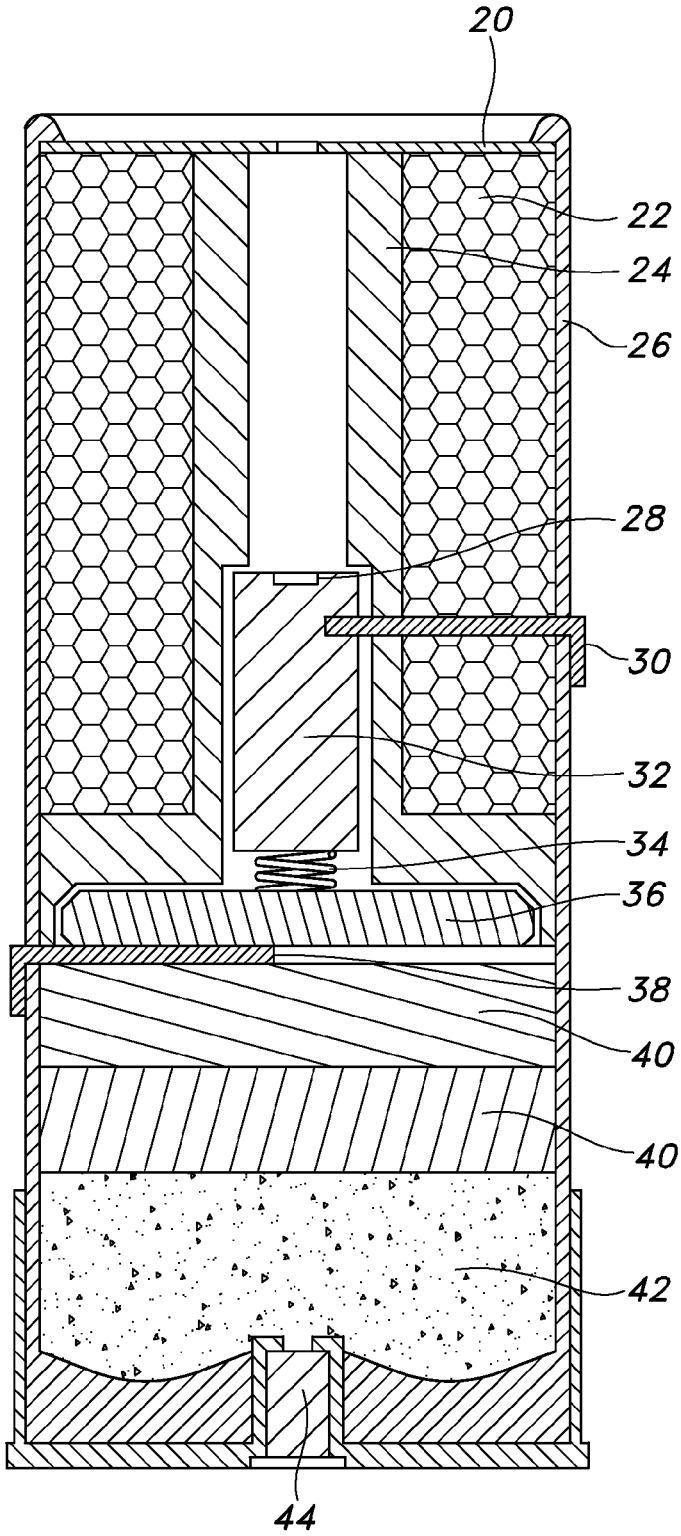
FIG. 1 is a cutaway side view of a shotgun cartridge as one embodiment of this invention.

| Drawings - Reference Numerals | |
|---|---|
| 20 | Overshot card |
| 22 | Shot |
| 24 | Insert |

-continued

| Drawings - Reference Numerals | |
|---|---|
| 26 | Hull |
| 28 | Lens |
| 30 | Negative Pin |
| 32 | Laser Module |
| 34 | Spring |
| 36 | Battery |
| 38 | Positive Pin |
| 40 | Wad |
| 42 | Powder |
| 44 | Primer |
| 46 | Chamber Wall |
| 48 | Firing Pin |
| 50 | Magazine Wall |
| 52 | Brass Cartridge Case |
| 54 | Metallic Bullet Core |

DETAILED DESCRIPTION OF THE INVENTION

Figure 2:
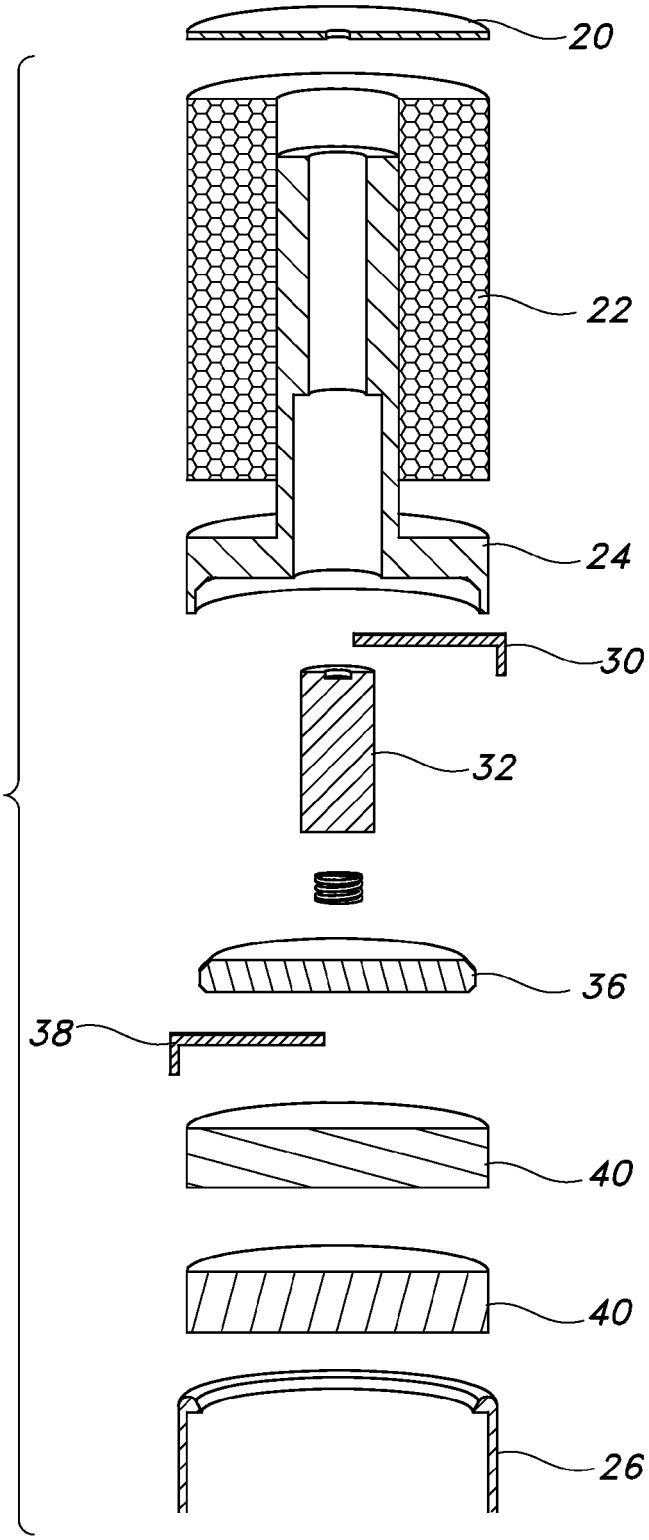
FIG. 2 is an exploded view of the individual components used to modify a shotgun cartridge.
Figure 3A:
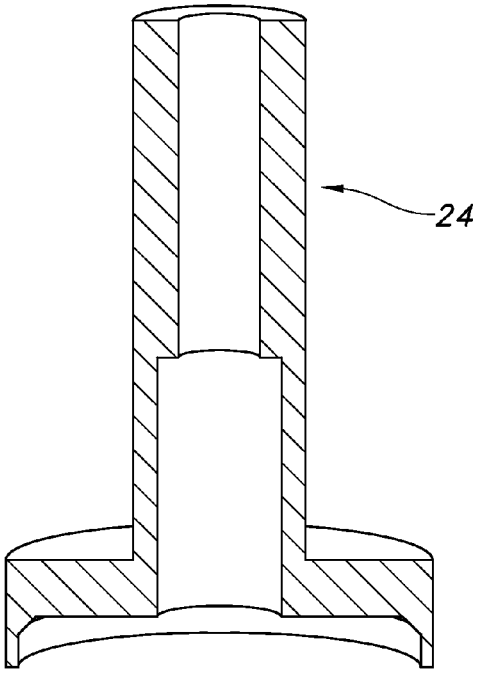
FIG. 3 is several views of the insert used to modify a shotgun cartridge, including cross section (FIG. 3A), oblique (FIG. 3B, bottom (FIG. 3C) and top (FIG. 3D) views.
Figure 3B:
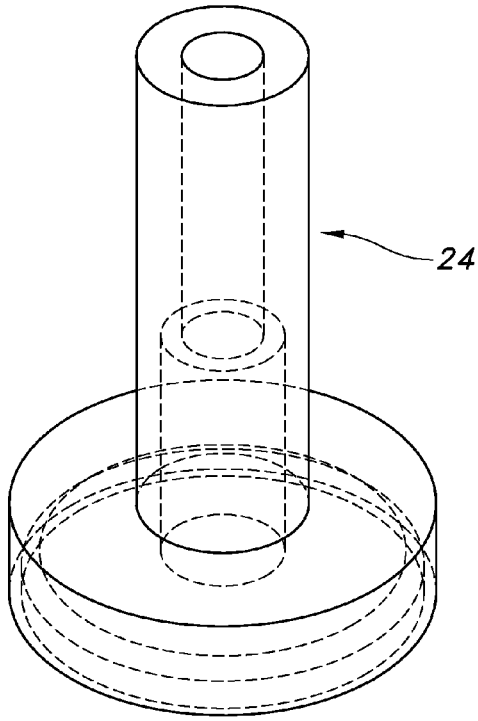
Figure 3C:
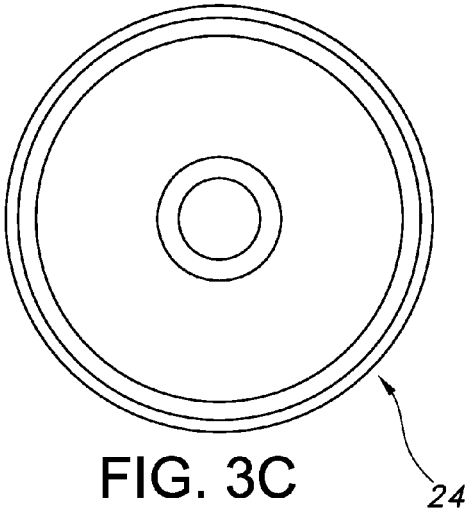
Figure 3D:
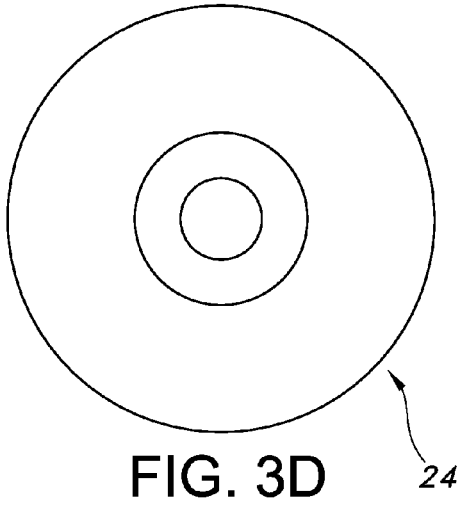

FIGS. 1, 2, and 3—First Embodiment

FIG. 1, the present embodiment, shows laser aimed small arm ammunition as used in a shotgun cartridge. At the mouth of said cartridge is an overshot card (20) that is held in place by a roll crimp in hull (26) of the cartridge. Said card is circular, sized to fit snugly inside hull (26), and has a circular hole through the middle to allow passage of a visible laser light. Said card is pressed against the face of an insert (24) to contain shot (22) within hull (26).

Insert (24), FIG. 3, could be injection molded of High-Density Polyethylene that is firm enough to hold laser module (32) and battery (36), yet soft enough for pins (30) and (38) to be inserted and contact laser module (32) and battery (36). The skirt of insert (24) holds laser module (32) parallel to the walls of hull (26) and so parallel to the chamber and bore of the firearm. Insert (24) holds battery (36) and laser module (32) in such a relationship that they are in direct contact only through spring (34). Said insert also holds the components of the circuit electrically insulated from the metallic shot (22) preventing a short circuit.

Shot (22) could be anything from small metallic "bird shot" to large caliber "buck shot" depending on the intended use of the cartridge. Shot (22) is contained in a cylindrical space formed by the interior wall of hull (26) and the exterior of insert (24). Shot could also be comprised of a bag containing lightweight material designed as a non-lethal cartridge to stun an adversary.

Electrical contact between laser module (32) and chamber wall (46) and later between chamber wall (46) and battery (36) is provided by pins (30) and (38). These pins are made of an electrically conducting material. In the shot shell of the present embodiment said negative pin (30) would most easily be installed using a staple gun to push the pin through hull (26), shot (22) and insert (24) to contact the brass exterior of laser module (32). Positive pin (38) is pushed through hull (26) to the bottom of battery (36). In the present embodiment these pins would not have to be insulated. Said pins have a breakaway notch cut in the forward face approximately even with hull (26) of the cartridge to facilitate breaking without excessive buildup of pressure in the chamber when the cartridge is fired.

Figure 4:
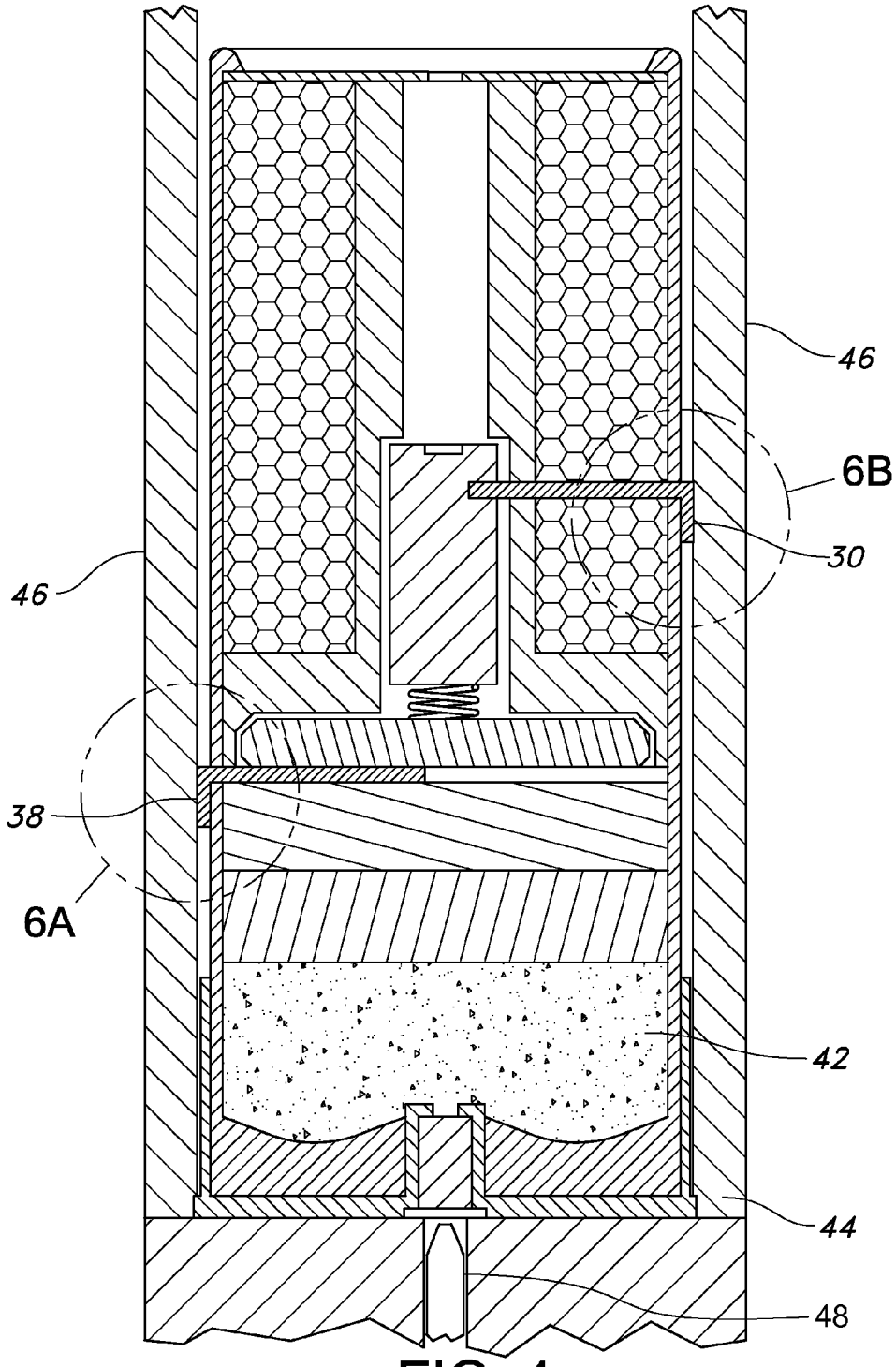
FIG. 4 shows the cutaway side view of a modified shotgun cartridge in the chamber of a firearm.

Laser module (32) is an off the shelf item of various external dimensions, light frequencies, power requirements and outputs. Some outputs project shaped visible laser lights such as crosses, circles, or various sized dots. Some lasers output infrared light visible only with optical equipment such as night vision devices. Laser modules are available pre-focused with lens (28) built in and the projected design pre-programmed. Laser module (32) fits into insert (24) from the bottom. Said laser (32) is prevented from slipping too far forward in insert (24) by a narrowing of the throat of said insert (24) as indicated by the oblique view in FIG. 4.

Spring (34) is attached to the base of laser module (32) and contacts the negative pole of battery (36). Said spring could be any electrical conducting device between the negative pole of battery (36) and laser module (34) circuitry, it may be insulated or not depending on the specific application. In the present embodiment no insulation would be needed. In the metallic cartridge illustrated (FIGS. 8 and 9) some form of insulation would be necessary to prevent shorting with the material within the projectile.

Battery (36) is an off the shelf item, best served by a long shelf life button battery.

The balance of the items drawn and listed are industry standard. Magazine wall (50) and firing pin (48) are standard firearm parts. Cartridge parts include cases (52), metal cores (54), primer (44), powder (42), and wads (40).

FIG. 2—Exploded view of components used to modify a shot shell in the present embodiment.

Overshot card (20) is shown obliquely to demonstrate the hole to allow passage of the laser light. Insert (24) has been shown cut in half lengthwise. All of the components, save pins (30) and (38), fit sequentially into the hull over an appropriate powder charge. Pins (30) and (38) are installed after the cartridge is sealed. Pin (30) pierces hull (26), shot (22), and insert (24) to contact the brass exterior of laser module (32). Pin (38) pierces hull (26) and slides between battery (36) and wad (40) making electrical contact with the bottom of battery (36).

Figure 8:
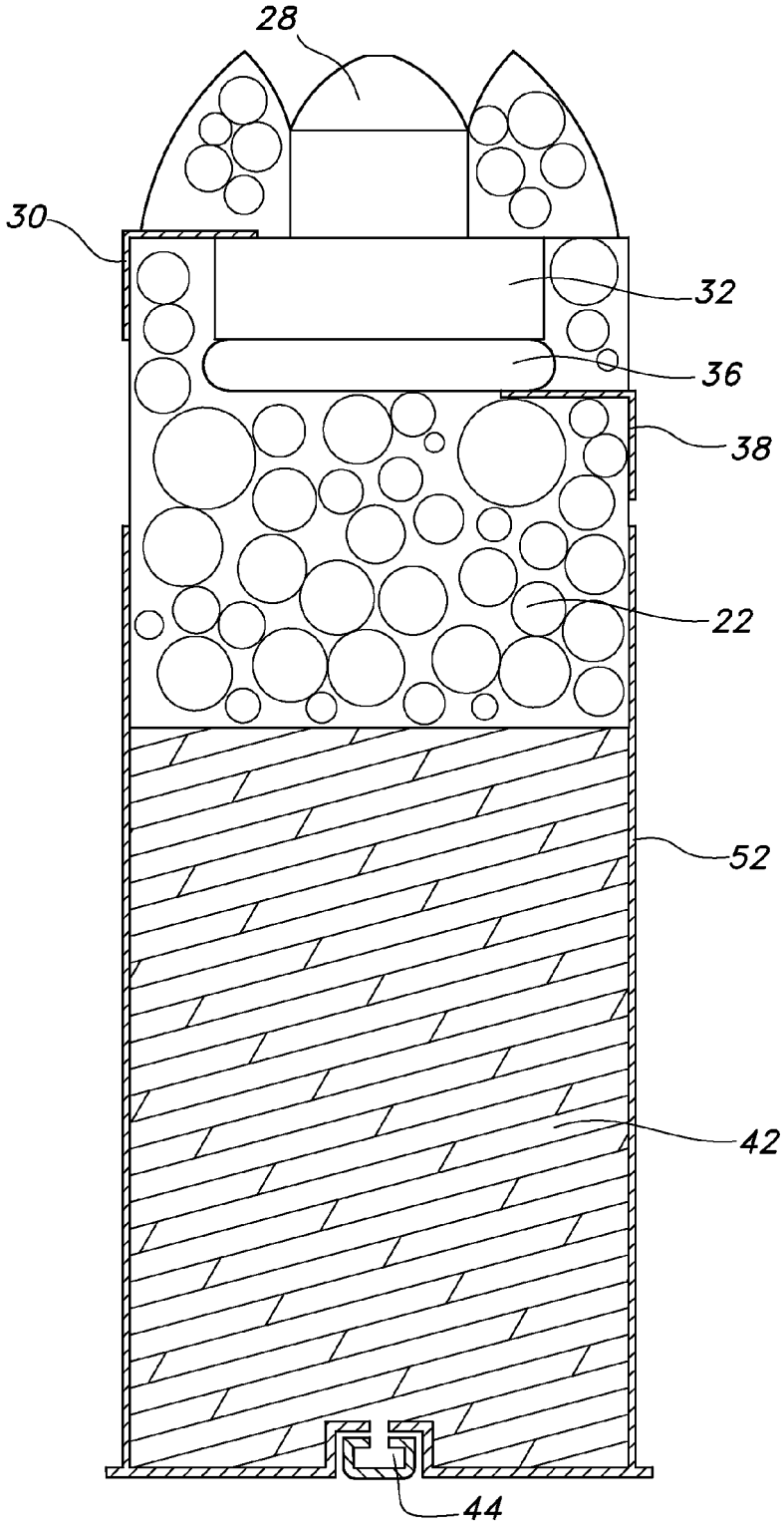
FIG. 8 shows this invention used in a metallic cartridge with a load of shot
Figure 9:
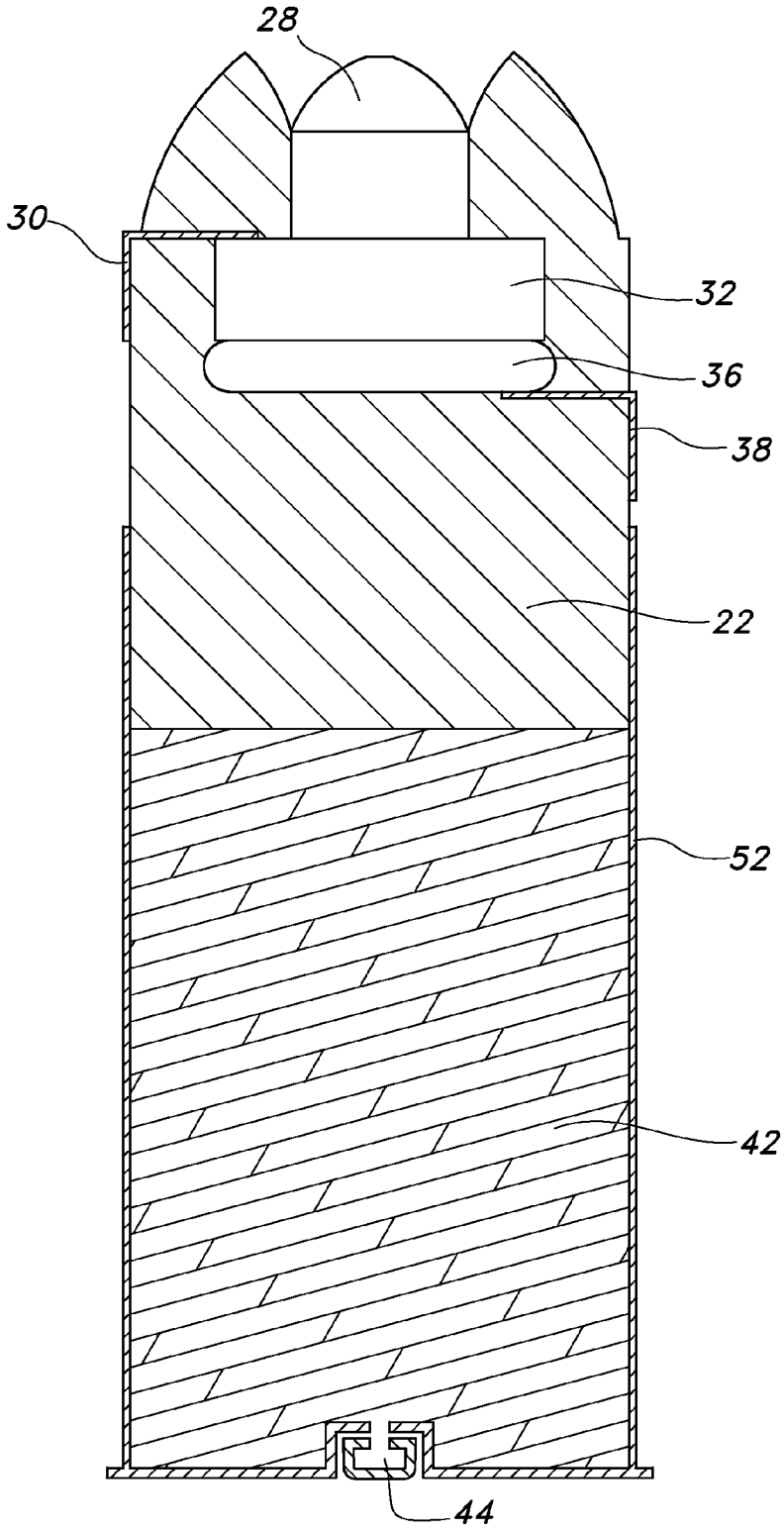
FIG. 9 shows this invention used in a metallic cartridge with a lead core

FIGS. 8 and 9—Alternative Embodiments

FIG. 8 shows an embodiment of the present invention in a metallic shot cartridge for handgun or rifle use. The laser module (32), spring (34), battery (36) and pins (38) are electrically insulated from the shot (22) and brass jacket of the bullet. This is accomplished by coating said module (32), spring (34) and battery (36) with an insulating plastic such as high density polyethylene similar to the insert in the first embodiment above. The pins (30) and (38) would be replaced with insulated metallic tape. The thin tape would allow it to fold down the outside of the bullet. The insulation is removed from the face of the tape on the outside of the bullets jacket. The exposed face of the tape would make electrical contact with the chamber of the firearm and complete the circuit. When the circuit is complete the laser module is activated and projects a beam of visible light through lens (28) and coaxially through the bore of the firearm. The insulation and adhesive under the tape insulates it from the electrically conducting metallic jacket of the bullet. Should the cartridge not be fired it can be removed from the chamber, saving the battery for a later use.

FIG. 9 repeats the description from FIG. 8, but embodied in a solid core bullet.

Operation—FIGS. 4, 5, 6, and 7

Figure 5:
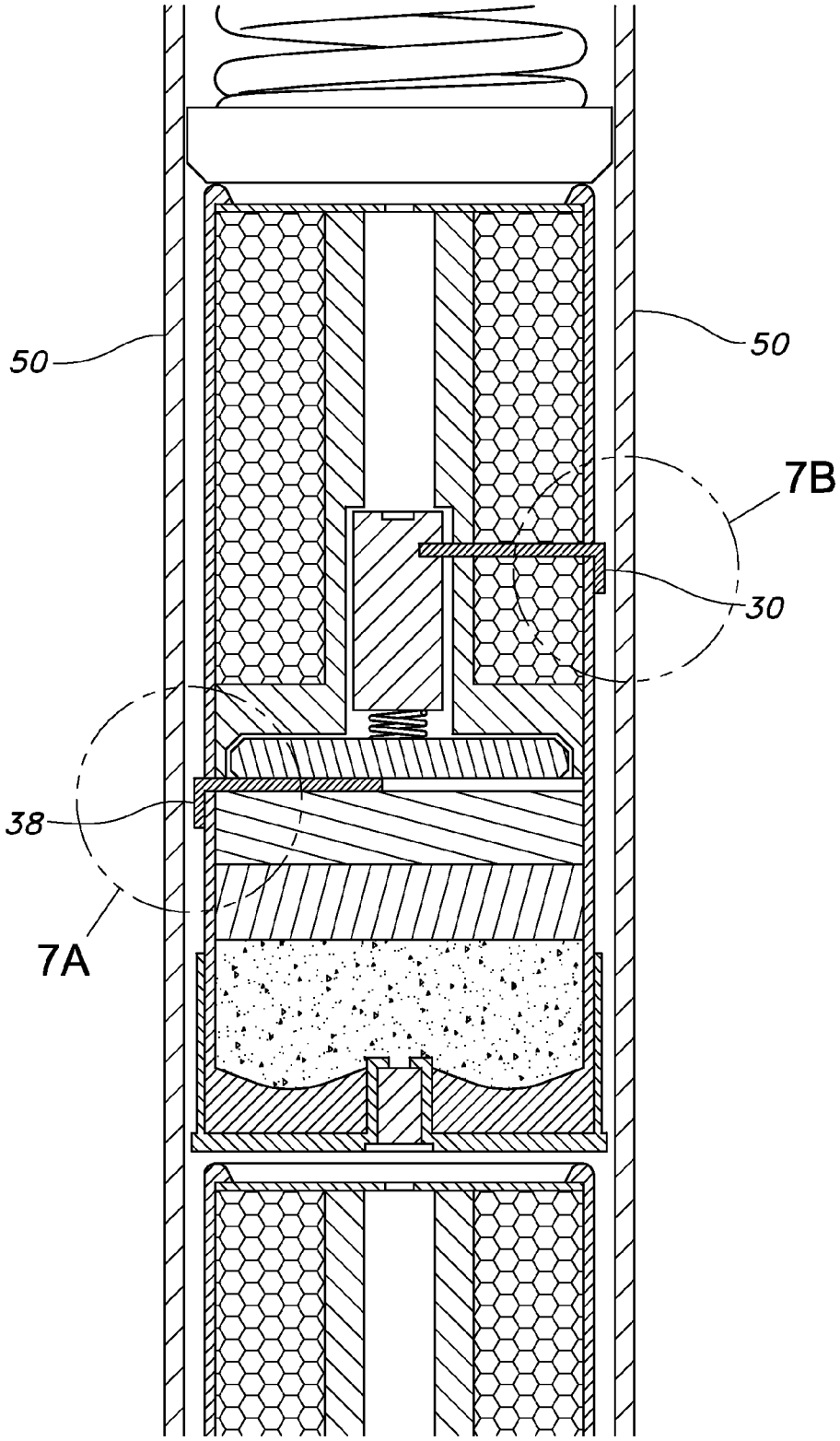
FIG. 5 shows the cutaway side view of a modified shotgun cartridge in the magazine of a firearm.
Figure 7A:
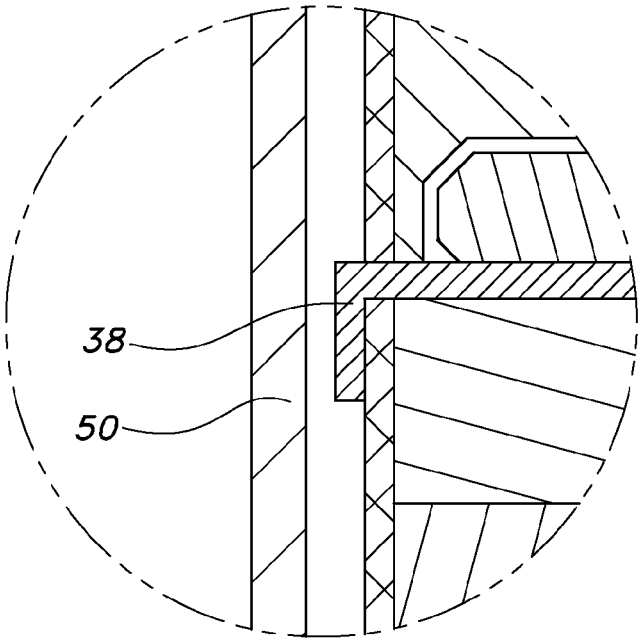
FIG. 7A and FIG. 7B are enlarged views of the insets of FIG. 5 showing pins do not contact magazine walls.
Figure 7B:
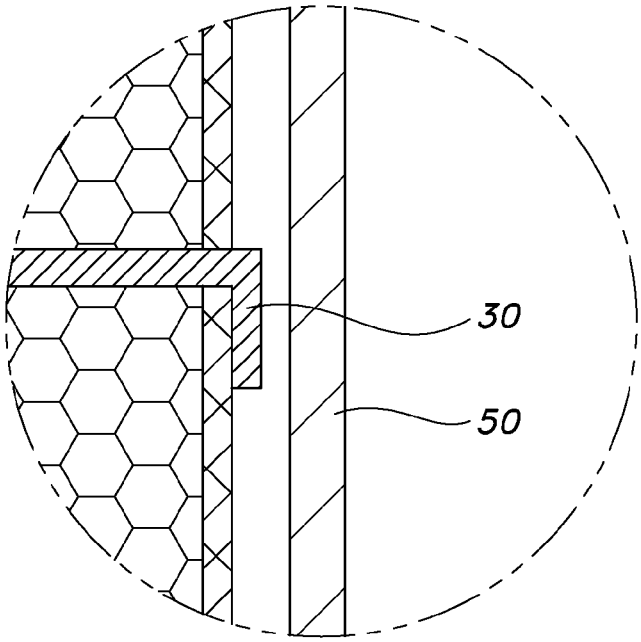

FIG. 5 shows a laser aimed small arm ammunition embodied in a shotgun cartridge. In operation said cartridge is placed in the magazine of a firearm. Since tolerances are significant pins (30) and (38) do not contact the electrical conducting metal of magazine (50) concurrently. FIG. 7 has an enlarged drawing showing lack of contact with magazine walls. It is possible for one pin or the other to touch, but this would not create a circuit and the laser would not activate.

Figure 6A:
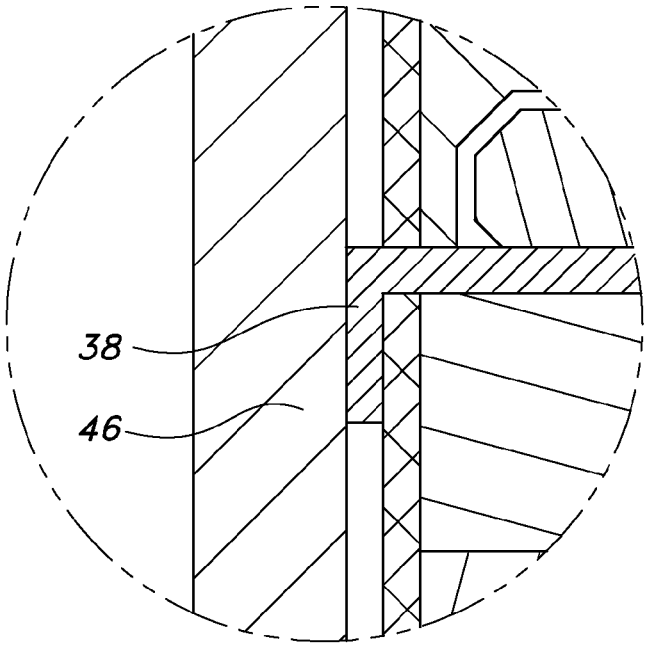
FIG. 6A and FIG. 6B are enlarged views of the insets of FIG. 4 showing pin contact with chamber walls.
Figure 6B:
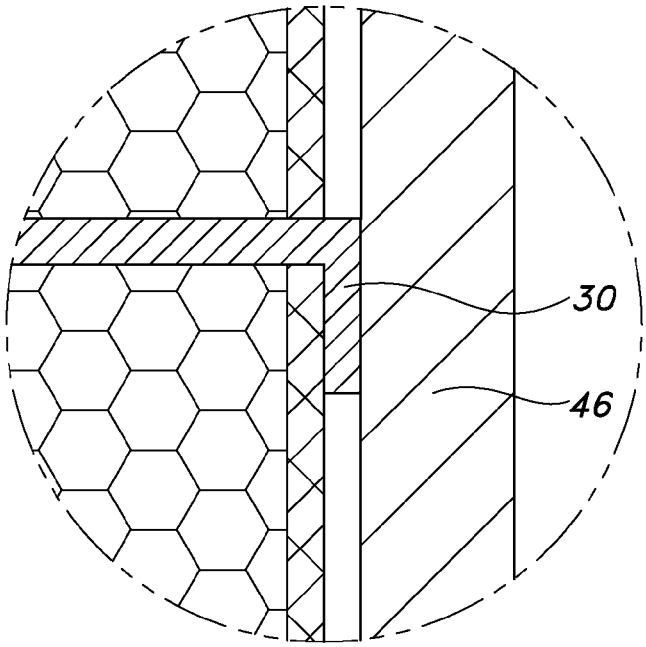

When a cartridge is placed in the chamber of a shotgun (FIG. 4) the tighter tolerances of the metallic chamber make electrical conducting contact with pins (30) and (38). FIG. 6 has an enlarged drawing showing contact with chamber walls. This establishes a circuit from the battery (36), through spring (34) and into the circuitry of the laser module (32), which is grounded in the case of module (32). Negative pin (30) connects the case of module (32) to the electrically conducting chamber wall (46). The current then flows around chamber wall (46) to positive pin (38) and back to battery (36). When the circuit is complete the laser is operational and sends a focused beam of light through the core of insert (24), and through a centrally located hole in overshot card (20). The light then travels coaxially through the barrel of the shotgun to illuminate the exact spot the shot will impact, within the range of the ammunition, should the gun be fired.

When the trigger is pulled firing pin (48) is released to contact primer (44) of the cartridge. Crushing the primer (44) will cause a primary detonation that ignites powder (42). The rapidly expanding gasses of powder (42) will impinge on wads (40) and force the entire payload including wads (40), pins (30) and (38), battery (36), laser module (32), insert (24), shot (22), and overshot card (20), down the barrel towards the target.

Pins (30) and (38) are either bent out of the way in the process of firing to remain in hull (26), broken at the breakaway notches to go downrange, or pulled entire through hull (26) to be sent downrange with the payload.

As the ignition and propulsion are almost instantaneous the laser illumination becomes irrelevant once the trigger is pulled.

If said cartridge is not fired it can be removed from the chamber and stored until needed. The laser will deactivate when removed from the chamber and the electrical circuit is broken. The cartridge can remain in the magazine with the laser off until chambered when ready to fire. It can remain in the magazine for the life of the battery, approximately ten years. Should the battery lose its charge the cartridge will continue to be useful as a normal cartridge for another thirty plus years.

Conclusion, Ramification, and Scope

Thus the utility of a self contained laser aimed cartridge can be readily recognized. It is lightweight, reliable, inexpensive to manufacture and purchase, and easy to use. It requires no modification to the firearm. With little training it provides a significant assist to what is a very stressful situation, protection of ones own life or the life of another from an aggressor. Fine motor skills are deficit at such a time and having a brightly illuminated dot appear on the aggressor negates the need for optical or iron sights.

While the above descriptions contain much specificity, these should not be construed as limitations on the scope of the invention, but rather as an exemplification of one preferred embodiment thereof. Many other variations are possible.

This embodiment is possible because technology has improved to the point that off the shelf laser modules and batteries are now small enough to be part of the payload of a standard shotgun cartridge. There are currently metallic handgun cartridges known to this inventor that are similar in many ways to a shotgun cartridge. They utilize a plastic jacket filled with loose shot in the place of a bullet. These cartridges are designed to be used primarily in handguns, but fire a shot charge rather than a solid bullet. This would simply be a different use with little modification to the invention. Said cartridge is designed for short range anti-personnel or animal control use so long range accuracy could be sacrificed. This would lessen the demands of extreme concentricity about a longitudinal axis and allow for looser tolerances in the placement of the battery and laser module.

There is within prior art a bullet that utilizes a metallic jacket that is filled with round metallic shot and liquid. (Canon, U.S. Pat. No. 3,972,286, Aug. 3, 1976). In place of pins (30) and (38) of the current embodiment, metallic tape insulated from the bullets core and metallic jacket would be used. The tape contacts the chamber walls and completes the circuit of a laser module and battery placed within the pellets in said bullet. (FIG. 8). An insert of a different shape would be used to insulate the battery and laser from the core pellets.

There is within prior art a metallic cartridge using a cold molded powdered metal core. (Joys, Anshutz, Ramsey, US 20100083861) With suitable modification of materials and construction methods this invention could work with such a bullet. (See FIG. 9).

Another embodiment of this invention might use a microswitch to complete the circuit when pressed by the close tolerances of the chamber walls.

Laser aimed small arms ammunition concepts could also be transferred directly larger caliber weapons such as tank or howitzers. A laser similar to the current embodiment could also be inserted in rocket propelled grenades or light anti-tank weapons.

The invention claimed is:

1. Electromagnetic radiation emitter aimed device comprising:

(a) a live cartridge capable of launching one or more projectiles at a target when fired from a firearm;

(b) an electromagnetic radiation generating module and power supply in an electronic circuit within said device capable of projecting a beam of electromagnetic radiation towards a target to aid in aiming the device, wherein said electronic circuit further comprises electricity-conducting contacts that penetrate said live cartridge and touch metallic chamber walls in a bore of said firearm to create a closed electronic circuit that initiates said beam of electromagnetic radiation; and (e) a non-electrically conducting insert to insulate the electromagnetic radiation generating module, power supply, and circuitry from metallic portions of the cartridge.

2. The device of claim 1 wherein said cartridge is a shotgun cartridge and said firearm is a shotgun.

3. The device of claim 1 wherein said cartridge is a metallic cartridge having a metallic jacket wherein (a)

(c) said electronic circuit is integral with the projectiles, the electromagnetic radiation generating module, and the power supply yet insulated from said metallic jacket of the metallic cartridge and wherein said electronic circuit penetrates the jacket of said cartridge to make contact with the chamber walls of said firearm.

4. The device of claim 1 wherein said electromagnetic radiation generating module is a laser.

5. The device of claim 4 wherein said laser emitted from said electromagnetic radiation generating module travels coaxially through the bore of the firearm and is used to aim said firearm.

6. The device of claim 1 wherein said electromagnetic radiation generating module produces visible light.

7. The device of claim 1 wherein said electromagnetic radiation generating module produces infrared light.

8. The device of claim 1 wherein said power supply is a battery.

* * * * *